US009747839B2

(12) United States Patent
Wang et al.

(10) Patent No.: US 9,747,839 B2
(45) Date of Patent: Aug. 29, 2017

(54) PIXEL DRIVING CIRCUIT, DRIVING METHOD, ARRAY SUBSTRATE AND DISPLAY APPARATUS

(71) Applicant: BOE TECHNOLOGY GROUP CO., LTD., Beijing (CN)

(72) Inventors: Ying Wang, Beijing (CN); Xinshe Yin, Beijing (CN); Guang Li, Beijing (CN); Liang Sun, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 101 days.

(21) Appl. No.: 14/650,687

(22) PCT Filed: Sep. 26, 2014

(86) PCT No.: PCT/CN2014/087600
§ 371 (c)(1),
(2) Date: Jun. 9, 2015

(87) PCT Pub. No.: WO2015/188520
PCT Pub. Date: Dec. 17, 2015

(65) Prior Publication Data

US 2016/0267843 A1 Sep. 15, 2016

(30) Foreign Application Priority Data

Jun. 13, 2014 (CN) ..... 2014 1 0265310

(51) Int. Cl.
*G09G 3/3258* (2016.01)
*G09G 3/3233* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC ..... G09G 3/3233; G09G 3/3258; G09G 2320/045; G09G 3/3291; G09G 3/3208
See application file for complete search history.

(56) References Cited

U.S. PATENT DOCUMENTS

2009/0121981 A1 5/2009 Yoo et al.
2010/0073266 A1 3/2010 Na et al.
(Continued)

FOREIGN PATENT DOCUMENTS

CN 102402940 A 4/2012
CN 102831859 A 12/2012
(Continued)

OTHER PUBLICATIONS

International Search Report Appln. No. PCT/CN2014/087600; Dated Apr. 3, 2015.
(Continued)

*Primary Examiner* — Gerald Johnson
(74) *Attorney, Agent, or Firm* — Ladas & Parry LLP

(57) ABSTRACT

A pixel driving circuit and a driving method thereof, and an array substrate are provided. The pixel driving circuit includes a data line (Data), a gate line (Gate), a first power supply line (ELVDD), a second power supply line (ELVSS), a reference signal line (ref), a light emitting device (D), a driving transistor (T7), a storage capacitor (C1), a reset unit, a data writing unit, a compensating unit and a light emitting control unit. The pixel driving circuit can compensate and remove non-uniformity in displaying caused by variances in threshold voltage among driving transistors.

20 Claims, 3 Drawing Sheets

(51) Int. Cl.
*G09G 3/3266* (2016.01)
*G09G 3/3291* (2016.01)

(52) U.S. Cl.
CPC ... *G09G 3/3291* (2013.01); *G09G 2300/0819* (2013.01); *G09G 2300/0842* (2013.01); *G09G 2300/0861* (2013.01); *G09G 2310/0278* (2013.01); *G09G 2320/045* (2013.01); *G09G 2330/028* (2013.01)

(56) References Cited

U.S. PATENT DOCUMENTS

| | | | | |
|---|---|---|---|---|
| 2011/0193856 | A1* | 8/2011 | Han | G09G 3/3233 345/214 |
| 2012/0062536 | A1 | 3/2012 | Park | |
| 2013/0069852 | A1 | 3/2013 | Liao et al. | |
| 2013/0082910 | A1* | 4/2013 | Lee | G09G 3/3208 345/76 |
| 2013/0127693 | A1 | 5/2013 | Lee et al. | |
| 2013/0314305 | A1 | 11/2013 | Liu et al. | |
| 2015/0213761 | A1 | 7/2015 | Chen | |

FOREIGN PATENT DOCUMENTS

| | | | |
|---|---|---|---|
| CN | 102930824 | A | 2/2013 |
| CN | 103000126 | A | 3/2013 |
| CN | 103474025 | A | 12/2013 |
| CN | 203433775 | U | 2/2014 |
| KR | 20100045578 | A | 5/2010 |
| KR | 20120041425 | A | 5/2012 |

OTHER PUBLICATIONS

Written Opinion of the International Searching Authority Appln. No. PCT/CN2014/087600; Dated Mar. 12, 2015.
First Chinese Office Action dated Mar. 20, 2017; Appln. No. 201410265310.6.

* cited by examiner

PIXEL DRIVING CIRCUIT, DRIVING METHOD, ARRAY SUBSTRATE AND DISPLAY APPARATUS

TECHNICAL FIELD OF THE DISCLOSURE

The present disclosure relates to a field of display technique, and particularly to a pixel driving circuit, a driving method, an array substrate and a display apparatus.

BACKGROUND

As a current type light emitting device, an Organic Light emitting Diode (OLED) is increasingly applied to a high performance Active Matrix Organic Light Emitting Device Display (AMOLED). With an increasing in the display size of a conventional Passive Matrix OLED (PMOLED), the conventional PMOLED requires a shorter single pixel driving time for displaying, and thus a transient current is needed to be increased, which renders an increasing in power consumption. Meanwhile, an application of the large current causes a voltage drop of the Indium Tin Oxide (ITO) line to decrease too much, rendering the operation voltage of OLED too high and in turn an efficiency of OLED is lower. An Active Matrix OLED (AMOLED) inputs an OLED current via switching transistors by progressive scanning for display, which can solve the above problems very well.

In designing of a pixel circuit of the AMOLED, a problem mainly to be solved is non-uniformity in luminance of OLED devices driven by pixel driving units in AMOLED.

Firstly, in AMOLED, a pixel driving unit is constituted by thin film transistors (TFTs) to supply a corresponding driving circuit to a light emitting device. As the inventor noticed, low temperature poly-Si Thin Film Transistors (LTPS TFTs) or Oxide TFTs are mostly adopted. As compared to the conventional amorphous-si TFT, LTPS TFT and Oxide TFT have a higher mobility and more stable characteristics, and thus are more suitable to be used in an AMOLED display. However, due to limitations of a crystallization process, LTPS TFTs, which are manufactured on a glass substrate with a large area, have non-uniformity in electrical parameters such as a threshold voltage, the mobility, etc, and such non-uniformity may result in variances in driving currents and luminances among OLEDs which can be perceived by human eyes, i.e., Mura phenomenon. Although a process for the Oxide TFTs shows a better uniformity, similar to a-Si TFTs, the threshold voltage of the Oxide TFT may drift under a high temperature or under a case that the Oxide TFT is supplied a voltage for a long time. Due to different display pictures, drifts of threshold voltages of TFTs in respective areas on a panel may be different from each other, which may cause variances in display luminance. Such variances in display luminance often render an image sticking phenomenon since such display luminance difference has a relation to a previously displayed image.

Since the OLED light emitting device is a device driven by a current (current-driven device), the threshold characteristic of the driving transistor in a pixel driving unit for driving the light emitting device to emit light has a great effect on the driving current and the ultimate display luminance. The threshold voltage of the driving transistor will drift under a voltage stress or light illumination, which causes the non-uniformity in the luminance of the resulted display.

In addition, in order to remove the effect caused by the variances in threshold voltages of the driving transistors, the existing pixel circuits are commonly designed to have a complex structure, which may render a low good manufacturing production rate of pixel circuits of AMOLED.

Therefore, in order to solve the above problem, there is a need for providing a pixel driving unit, a driving method and a pixel circuit in embodiments of the present disclosure.

SUMMARY

Embodiments of the present disclosure provide a pixel driving circuit comprising a data line, a gate line, a first power supply line, a second power supply line, a reference signal line, a light emitting device, a driving transistor, a storage capacitor, a reset unit, a data writing unit, a compensating unit and a light emitting control unit.

The data line is configured to supply a data voltage.

The gate line is configured to supply a scan voltage.

The first power supply line is configured to supply a first power supply voltage, the second power supply line is configured to supply a second power supply voltage, and the reference signal line is configured to supply a reference voltage.

The reset unit is connected to the reference signal line and the storage capacitor, and is configured to reset a voltage across the storage capacitor to a predefined signal voltage.

The data writing unit is connected to the gate line, the data line and a second terminal of the storage capacitor, and is configured to write information including a data voltage into the second terminal of the storage capacitor.

The compensating unit is connected the gate line, a first terminal of the storage capacitor and the driving transistor, and is configured to write information including a threshold voltage of the driving transistor and an information of the first power supply voltage into the first terminal of the storage capacitor.

The light emitting control unit is connected to the reference signal line, the second terminal of the storage capacitor, the driving transistor and the light emitting device, and is configured to write the reference voltage into the second terminal of the storage capacitor and control the driving transistor to drive the light emitting device to emit light.

The first terminal of the storage capacitor is connected to a gate of the driving transistor, and the storage capacitor is configured to transfer the information including the data voltage into the gate of the driving transistor.

The driving transistor is connected to the first power supply line, the light emitting device is connected to the second power supply line, and the driving transistor is configured to control an amplitude of a current flowing through the light emitting device according to the information including the data voltage, the threshold voltage of the driving transistor, the reference voltage and the first power supply voltage under the control of the light emitting control unit.

In an example, the reset unit comprises a reset control line, a reset signal line, a first transistor and a second transistor, the first transistor has a gate connected to the reset control line, a source connected the reset signal line and a drain connected to the first terminal of the storage capacitor, and is configured to write a voltage on the reset signal line into the first terminal of the storage capacitor; the second transistor has a gate connected to the reset control line, a source connected the reference signal line and a drain connected to the second terminal of the storage capacitor, and is configured to write the reference voltage into the second terminal of the storage capacitor.

In an example, the first and second transistors are P type transistors.

In an example, the data writing unit comprises a fourth transistor, the fourth transistor has a gate connected to the gate line, a source connected the data line and a drain connected to the second terminal of the storage capacitor, and is configured to write the data voltage into the second terminal of the storage capacitor.

In an example, the fourth transistor is a P type transistor.

In an example, the compensating unit comprises a third transistor, the third transistor has a gate connected to the gate line, a source connected to the first terminal of the storage capacitor and a drain connected to the drain of the driving transistor, and is configured to write the information including the threshold voltage of the driving transistor and the first power supply voltage into the first terminal of the storage capacitor.

In an example, the third transistor is a P type transistor.

In an example, the light emitting control unit comprises a light emitting control line, a fifth transistor and a sixth transistor, the fifth transistor has a gate connected to the light emitting control line, a source connected to the reference signal line and a drain connected to the second terminal of the storage capacitor, and is configured to write the reference voltage into the second terminal of the storage capacitor such that the storage capacitor transfers the reference voltage to the gate of the driving transistor; and the sixth transistor has a gate connected to the light emitting control line, a source connected to a first terminal of the light emitting device and a drain connected to the drain of the driving transistor, and is configured to control the light emitting device to emit light, the driving transistor is configured to control the amplitude of the current flowing through the light emitting device according to the information including the data voltage, the threshold voltage of the driving transistor, the reference voltage and the first power supply voltage under the control of the light emitting control unit.

In an example, the fifth and sixth transistors are P type transistors.

In an example, the driving transistor is a P type transistor.

In the embodiments of the present disclosure, there is further provided a driving method for any one of the above described pixel driving circuit. The driving method comprises following steps:

during a resetting period, resetting the voltage across the storage capacitor to a predefined voltage by the reset unit;

during a data voltage writing period, writing the data voltage into the second terminal of the storage capacitor by the data writing unit, and writing the information including the threshold voltage of the driving transistor and the first power supply voltage into the first terminal of the storage capacitor by the compensating unit;

during a light emitting period, writing the reference voltage into the second terminal of the storage capacitor by the light emitting control unit, transferring the information including the data voltage and the reference voltage to the gate of the driving transistor by the storage capacitor, and controlling the amplitude of the current flowing through the light emitting device according to the information including the data voltage, the threshold voltage of the driving transistor, the reference voltage and the first power supply voltage to drive the light emitting device to emit light by the driving transistor under the control of the light emitting control unit.

During the resetting period, the reset unit resets voltages at the two terminals of the storage capacitor to the voltage on the rest signal line and the reference voltage, respectively.

In the embodiments of the present disclosure, there is further provided an array substrate comprising any one of the above described pixel driving circuit.

In the embodiments of the present disclosure, there is further provided a display apparatus comprising the above described array substrate.

In the pixel driving unit according to the embodiments of the present disclosure, the first power supply voltage and the threshold voltage of the driving transistor are loaded together to the first terminal of the storage capacitor through the drain of the driving transistor by aid of a structure in which the gate and the drain of the driving transistor of the driving transistor are connected to each other (the gate and drain of the driving transistor are connected with each other through the third switch transistor when a gate control signal is ON), such that the threshold voltage of the driving transistor is compensated; the non-uniformity in display luminance caused by variances in threshold voltages of the driving transistors and the image sticking phenomenon caused by the threshold voltage drifts can be effectively removed during the process for driving the light emitting device. The problem of non-uniformity in display luminance among the light emitting devices in different pixel driving units of the AMOLED caused by variances in the threshold voltages of the driving transistors corresponding to the light emitting devices can be avoided in the AMOLED. Therefore, a driving effect of the pixel driving unit on the light emitting device is improved, and a quality of the AMOLED is further improved.

DETAILED DESCRIPTION

Descriptions will be given to particular implementations of the present disclosure below, taken in conjunction with the accompanying drawings of the embodiments of the present disclosure. Obviously, the following embodiments are only illustrative for the embodiments of the present disclosure, but not intended to limit the scope of the present disclosure.

It should be explained that a gate of a transistor as defined in the embodiments of the present disclosure is a terminal for controlling the transistor to be turned on, and a source and a drain are two terminals other than the gate of the transistor. The source and the drain are only descriptive for connection relationship of the transistor, but not limitative on current direction. Those skilled in the art can clearly know its operational principle and stage according to the type of the transistor, the signal connection manner, and etc.

Figure 1:
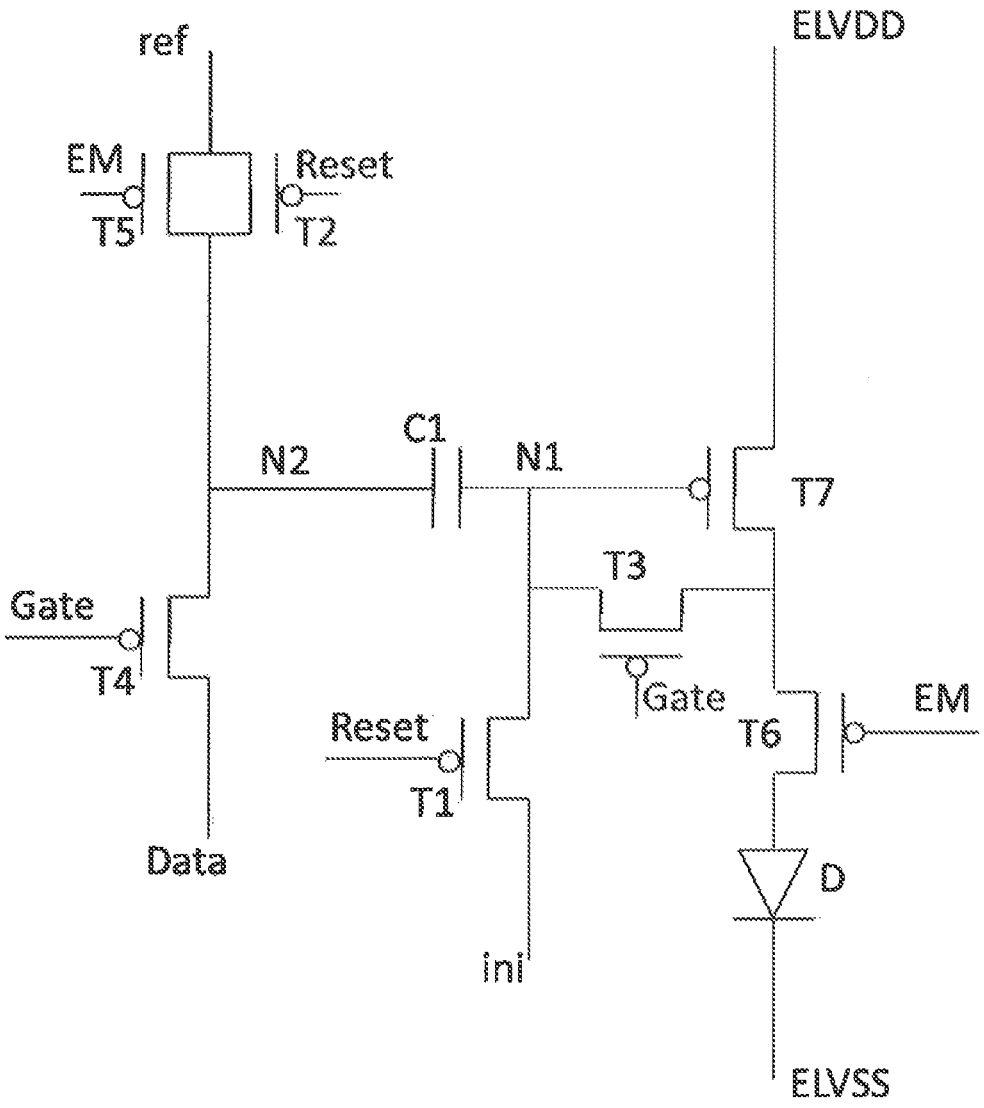
FIG. 1 is a diagram of a pixel driving circuit according to embodiments of the present disclosure.

As shown in FIG. 1, a pixel driving circuit of the embodiments of the present disclosure comprises a data line Data, a gate line Gate, a first power supply line ELVDD, a second power supply line ELVSS, a reference signal line ref, a light emitting device D, a driving transistor T7, a storage capacitor C1, a reset unit, a data writing unit, a compensating unit and a light emitting control unit. The data line Data is configured to supply a data voltage, the gate line Gate is configured to supply a scan voltage, the first power supply line ELVDD is configured to supply a first power supply voltage, the second power supply line ELVSS is configured to supply a second power supply voltage, and the reference signal line ref is configured to supply a reference voltage.

The light emitting device D may be an organic light emitting diode. The driving transistor T7 has a gate connected to a first terminal N1 of the storage capacitor C1, a source connected to the first power supply line ELVDD and a drain connected to the light emitting control unit.

The reset unit is connected to the reference signal line ref and the storage capacitor C1, and is configured to reset a voltage across the storage capacitor C1 to a predefined voltage.

The data writing unit is connected to the gate line Gate, the data line Data and a second terminal N2 of the storage capacitor C1, and is configured to write information including a data voltage into the second terminal N2 of the storage capacitor C1.

The compensating unit is connected the gate line Gate, the first terminal N1 of the storage capacitor C1 and the driving transistor T7, and is configured to write information including a threshold voltage of the driving transistor and the first power supply voltage into the first terminal N1 of the storage capacitor C1.

The light emitting control unit is connected to the reference signal line ref, the second terminal N2 of the storage capacitor C1, the driving transistor T7 and the light emitting device D, and is configured to write the reference voltage into the second terminal N2 of the storage capacitor C1 and control the driving transistor T7 to drive the light emitting device D to emit light.

The first terminal N1 of the storage capacitor C1 is connected to the gate of the driving transistor T7, and the storage capacitor C1 is configured to transfer the information including the data voltage into the gate of the driving transistor T7.

The driving transistor T7 is connected to the first power supply line ELVDD, the light emitting device D is connected to the second power supply line ELVSS, and the driving transistor T7 is configured to control an amplitude of a current flowing through the light emitting device D according to the information including the data voltage, the threshold voltage of the driving transistor T7, the reference voltage and the first power supply voltage under the control of the light emitting control unit.

In the driving circuit according to the present embodiment, the threshold voltage of the driving transistor T7 can be compensated during the process for driving the light emitting device by extracting the threshold voltage of the driving transistor through the compensating unit, such that the non-uniformity in display luminance caused by variances in threshold voltages of the driving transistors and the image sticking phenomenon caused by the threshold voltage drifts can be effectively removed, and the problem of non-uniformity in display luminance among the light emitting devices in different pixel driving units of the AMOLED caused by variances in the threshold voltages of the driving transistors corresponding to the light emitting devices can be avoided.

Figure 2:
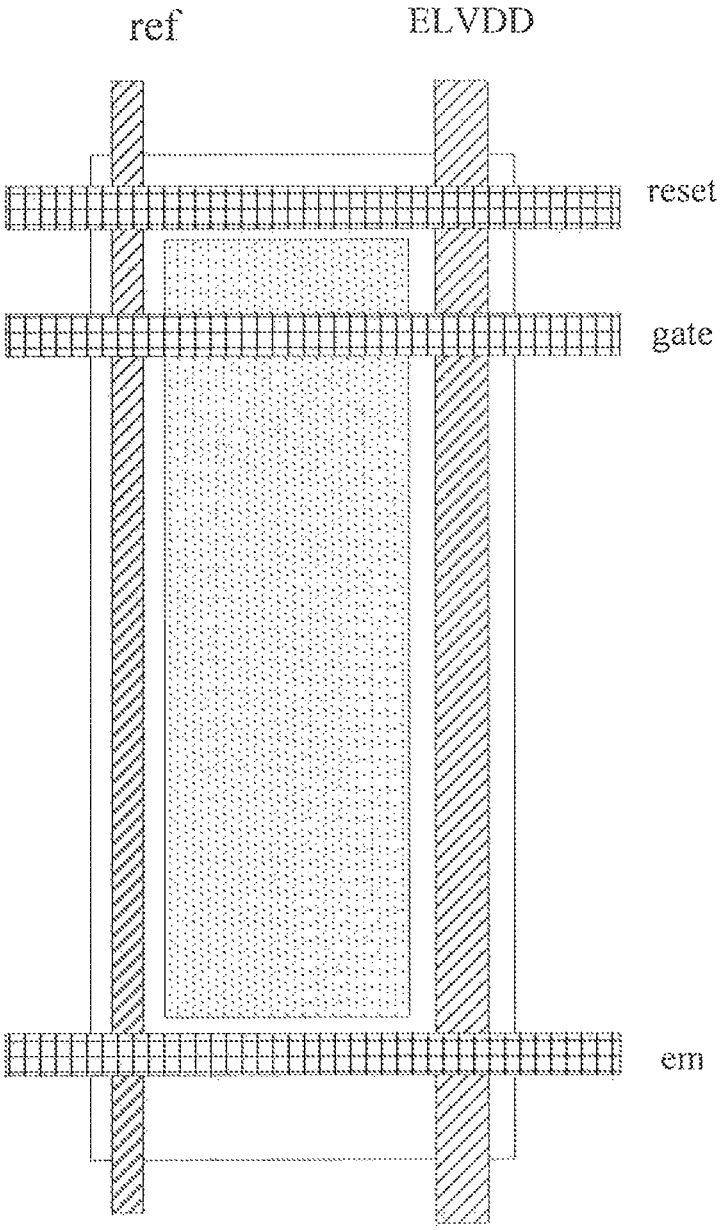
FIG. 2 is a structural diagram of a pixel according to the embodiments of the present disclosure.

In addition, the light emitting control unit writes the reference voltage into the second terminal N2 of the storage capacitor C1. As shown in FIG. 2, the reference voltage is transmitted through the reference signal line ref which is separate from the first power supply line ELVDD. During the process for driving, a current flowing through the reference signal line ref is small, and a voltage drop in the reference signal line is also small. The storage capacitor is connected to the gate of the driving transistor. Since the reference voltage is more stable relative to the first power supply voltage, the voltage at the gate of the driving transistor is more stable, and thus the problem of uniformity in luminance among different pixels caused by the effect of the drop of the first power supply voltage on the current can be avoided.

In addition, such pixel structure can reduce the effect on the display uniformity caused by the variance in the DC voltage on the reference signal line ref to the greatest extent, and can achieve a purpose that adjacent pixels share the reference signal line ref, reduce the area occupied by the pixel driving circuit to the greatest extent so as to increase an aperture ratio.

It should be explained that FIG. 2 is only illustrative for the pixel structure but not limitative for the pixel structure, and other arrangement can be adopted in actual design.

In the present embodiment, the reset unit comprises a reset control line Reset, a reset signal line ini, a first transistor T1 and a second transistor T2. The first transistor T1 has a gate connected to the reset control line Reset, a source connected the reset signal line ini and a drain connected to the first terminal of the storage capacitor C1, and is configured to write a voltage Vini on the reset signal line ini into the first terminal of the storage capacitor C1. The second transistor T2 has a gate connected to the reset control line Reset, a source connected the reference signal line ref and a drain connected to the second terminal of the storage capacitor C1, and is configured to write the reference voltage Vref into the second terminal of the storage capacitor C1. That is, voltages at the two terminals of C1 are reset to Vini and Vref respectively.

The data writing unit comprises a fourth transistor T4. The fourth transistor T4 has a gate connected to the gate line Gate, a source connected the data line Gate and a drain connected to the second terminal of the storage capacitor C1, and is configured to write the data voltage Vdata into the second terminal of the storage capacitor. That is, the voltage at the point N2 is set to Vdata.

The compensating unit comprises a third transistor T3. The third transistor T3 has a gate connected to the gate line Gate, a source connected to the first terminal of the storage capacitor C1 and a drain connected to the drain of the driving transistor T7, and is configured to write the information including the threshold voltage Vth of the driving transistor T7 and the first power supply voltage into the first terminal of the storage capacitor C1. That is, the voltage at the point N1 is Vdd−Vth, where Vdd is the first power supply voltage on the first power supply line ELVDD, and Vth is the threshold voltage of the driving transistor T7.

The light emitting control unit comprises a light emitting control line EM, a fifth transistor T5 and a sixth transistor T6. The fifth transistor T5 has a gate connected to the light emitting control line EM, a source connected to the reference signal line ref and a drain connected to the second terminal of the storage capacitor C1, and is configured to write the reference voltage Vref into the second terminal of the storage capacitor C1 such that the storage capacitor C1 transfers the reference voltage Vref to the gate of the driving transistor T7. The sixth transistor T6 has a gate connected to the light emitting control line EM, a source connected to a first terminal of the light emitting device D and a drain connected to the drain of the driving transistor T7, and is configured to control the light emitting device D to emit light, that is, the driving transistor T7 can drive a current to flow through the light emitting device D only when T6 is turned on. The driving transistor T7 is configured to control the amplitude of the current flowing through the light emitting device D according to the information including the data voltage Vdata, the threshold voltage Vth of the driving transistor, the first power supply voltage Vdd and the reference voltage Vref under the control of the light emitting control unit.

Figure 3:
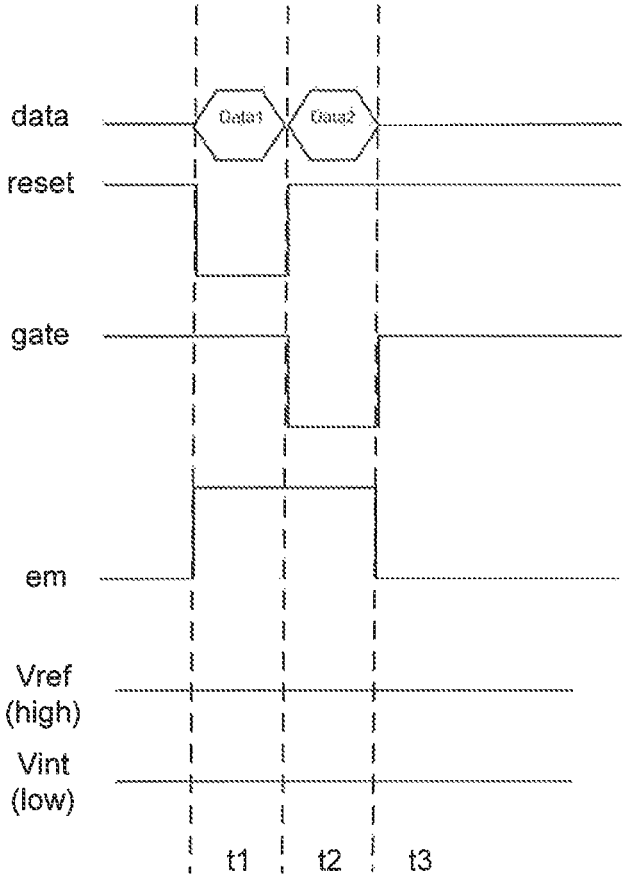
FIG. 3 is a timing diagram of the pixel driving circuit shown in FIG. 1.

As shown in FIG. 3, there are three periods when the circuit structure according to the present embodiment.

During a first period t1, a signal on the reset control line Reset is valid, T1 and T2 are turned on to reset the two terminals of the storage capacitor C1. At this time, the voltage Vini on the reset signal line ini is written to the point N1, and the point N2 is at the reference voltage Vref.

During a second period t2, a signal on the gate line is valid, T3 and T4 are turned on, Vdata is written into the point N2, Vdd−Vth is written into the point N1, and the voltage stored by the storage capacitor C1 is Vdd−Vth−Vdata at this time. During this period, T3 writes the information including the first power supply voltage and the threshold voltage of the driving transistor into the first terminal of the storage capacitor C1.

During a third period t3, a signal on the light emitting control line EM is valid, T5 and T6 are turned on, T5 is connected to the reference signal line ref, the voltage at the point N2 is Vref, the voltage at the point N1 is Vdd−Vth−Vdata+Vref which is the voltage at the gate of the driving transistor, the voltage at the source of the driving transistor is Vdd, a gate-source voltage Vgs of the driving transistor is Vdd−Vth−Vdata+Vref−Vdd, the current flowing through the light emitting device is $I=\frac{1}{2}\mu Cox(W/L)(Vgs-Vth)^2=\frac{1}{2}\mu Cox(W/L)(Vref-Vdata)^2$, where μ is a carrier mobility, Cox is capacitance of a gate oxide layer, W/L is a width-length ratio of the driving transistor.

It can be seen from the above equation of the current flowing through the light emitting device that the current I is irrelevant to the threshold voltage Vth of the driving transistor, and thus the problem of non-uniformity in display luminance among the different pixels of the AMOLED caused by variances in the threshold voltages of the driving transistors in the pixels can be avoided. Furthermore, the current I is irrelevant to Vdd, Vref is only used to charge the storage capacitor, the current flowing through the corresponding lines is small and the corresponding voltage drop is also small. The storage capacitor is connected to the gate of the driving transistor. Since Vref is more stable relative to Vdd, the voltage at the gate of the driving transistor is more stable, and thus the problem of uniformity in luminance among different pixels caused by the effect of the drop of Vdd on the current can be avoided.

In the driving transistor, the first transistor, the second transistor, the third transistor, the fourth transistor, the fifth transistor and the sixth transistor in the above embodiment are all P type transistors. Of course, they may also be N type transistor, or a combination of P type transistors and N type transistors with different valid signals on gate control signal lines.

In the embodiments of the present disclosure, there is further provided a driving method for any one of the above described pixel driving circuit. The driving method comprises following process.

During a resetting period, the reset unit resets the voltage across the storage capacitor to a predefined voltage.

During a data voltage writing period, the data writing unit writes the data voltage into the second terminal of the storage capacitor, and the compensating unit writes the information including the threshold voltage of the driving transistor and the first power supply voltage into the first terminal of the storage capacitor.

During a light emitting period, the light emitting control unit writes the reference voltage into the second terminal of the storage capacitor, the storage capacitor transfers the information including the data voltage and the reference voltage to the gate of the driving transistor, and the driving transistor controls the amplitude of the current flowing through the light emitting device according to the information including the data voltage, the threshold voltage of the driving transistor, the reference voltage and the first power supply voltage to drive the light emitting device to emit light under the control of the light emitting control unit.

During the resetting period, the reset unit resets the voltages at the two terminals of the storage capacitor to the voltage on the rest signal line and the reference voltage, respectively.

For particular driving steps, we can refer to the descriptions for the three operational periods in the above embodiment, and repeated descriptions are omitted herein.

In the embodiments of the present disclosure, there is further provided an array substrate comprising the pixel driving circuit according to the above embodiment.

In the embodiments of the present disclosure, there is further provided a display apparatus comprising the above described array substrate. The display apparatus may be any product or component having display function comprising AMOLED panel, television, digital frame, cell phone, tablet computer and so on.

The above descriptions are only for illustrating the embodiments of the present disclosure, and in no way limit the scope of the present disclosure. It will be obvious that those skilled in the art may make various changes and variations to the above embodiments without departing the spirit and scope of the present disclosure. Therefore, all of equivalent technical solutions are intended to be included within the spirit and scope of the present disclosure as defined by the accompanying claims.

The present application claims priority of a Chinese Patent Application No. 201410265310.6 filed on Jun. 13, 2014, the content disclosed in the above Chinese Patent Application is incorporated herein as a part of the present application by reference in its entirety.

What is claimed is:

1. A pixel driving circuit, comprising: a data line, a gate line, a first power supply line, a second power supply line, a reference signal line, a light emitting device, a driving transistor, a storage capacitor, a reset unit, a data writing unit, a compensating unit and a light emitting control unit;

the data line is configured to supply a data voltage, the gate line is configured to supply a scan voltage, the first power supply line is configured to supply a first power supply voltage, the second power supply line is configured to supply a second power supply voltage, and the reference signal line is configured to supply a reference voltage, the reset unit comprises a reset control line, a reset signal line, a first transistor and a second transistor, is connected to the reference signal line and the storage capacitor, and is configured to reset a voltage across the storage capacitor to a predefined signal voltage, the data writing unit comprises a fourth transistor, is connected to the gate line, the data line and a second terminal of the storage capacitor, and is configured to write information including a data voltage into the second terminal of the storage capacitor, the compensating unit comprises a third transistor, is connected the gate line, a first terminal of the storage capacitor and the driving transistor, and is configured to write information including a threshold voltage of the driving transistor and the first power supply voltage into the first terminal of the storage capacitor, the light emitting control unit comprises a light emitting control line, a fifth transistor and a sixth transistor, is connected to the reference signal line, the second terminal of the storage capacitor, the driving transistor and the light emitting device, and is configured to write the reference voltage into the second terminal of the storage capacitor during a light emitting period and control the driving transistor to drive the light emitting device to emit light, the first terminal of the storage capacitor is connected to a gate of the driving transistor, and the storage capacitor is configured to transfer the information including the data voltage into the gate of the driving transistor, and the driving transistor is connected to the first power supply line, the light emitting device is connected to the second power supply line, and the driving transistor is configured to control an amplitude of a current flowing through the light emitting device according to the information including the data voltage, the threshold voltage of the driving transistor, the reference voltage and the first power supply voltage under the control of the light emitting control unit.

2. The pixel driving circuit of claim 1, wherein the first transistor has a gate connected to the reset control line, a source connected the reset signal line and a drain connected to the first terminal of the storage capacitor, and is configured to write a voltage on the reset signal line into the first terminal of the storage capacitor;

the second transistor has a gate connected to the reset control line, a source connected the reference signal line and a drain connected to the second terminal of the storage capacitor, and is configured to write the reference voltage into the second terminal of the storage capacitor.

3. The pixel driving circuit of claim 2, wherein the first and second transistors are P type transistors.

4. The pixel driving circuit of claim 1, wherein the fourth transistor has a gate connected to the gate line, a source connected the data line and a drain connected to the second terminal of the storage capacitor, and is configured to write the data voltage into the second terminal of the storage capacitor.

5. The pixel driving circuit of claim 4, wherein the fourth transistor is a P type transistor.

6. The pixel driving circuit of claim 1, wherein the third transistor has a gate connected to the gate line, a source connected to the first terminal of the storage capacitor and a drain connected to the drain of the driving transistor, and is configured to write the information including the threshold voltage of the driving transistor and the first power supply voltage into the first terminal of the storage capacitor.

7. The pixel driving circuit of claim 6, wherein the third transistor is a P type transistor.

8. The pixel driving circuit of claim 1, wherein the fifth transistor has a gate connected to the light emitting control line, a source connected to the reference signal line and a drain connected to the second terminal of the storage capacitor, and is configured to write the reference voltage into the second terminal of the storage capacitor such that the storage capacitor transfers the reference voltage to the gate of the driving transistor; and the sixth transistor has a gate connected to the light emitting control line, a source connected to a first terminal of the light emitting device and a drain connected to the drain of the driving transistor, and is configured to control the light emitting device to emit light, the driving transistor is configured to control the amplitude of the current flowing through the light emitting device according to the information including the data voltage, the threshold voltage of the driving transistor, the first power supply voltage and the reference voltage under the control of the light emitting control unit.

9. The pixel driving circuit of claim 8, wherein the driving transistor, the fifth and sixth transistors are P type transistors.

10. A driving method for a pixel driving circuit, comprising following steps:

during a resetting period, resetting the voltage across the storage capacitor to a predefined voltage by the reset unit;

during a data voltage writing period, writing the data voltage into the second terminal of the storage capacitor by the data writing unit, and writing the information including the threshold voltage of the driving transistor and the first power supply voltage into the first terminal of the storage capacitor by the compensating unit; and during a light emitting period, writing the reference voltage into the second terminal of the storage capacitor by the light emitting control unit, transferring the information including the data voltage and the reference voltage to the gate of the driving transistor by the storage capacitor, and controlling the amplitude of the current flowing through the light emitting device according to the information including the data voltage, the threshold voltage of the driving transistor, the reference voltage and the first power supply voltage to drive the light emitting device to emit light by the driving transistor under the control of the light emitting control unit.

11. The driving method of claim 10, wherein during the resetting period, the reset unit resets voltages at the two terminals of the storage capacitor to the voltage on the rest signal line and the reference voltage, respectively.

12. An array substrate comprising a pixel driving circuit, wherein the pixel driving circuit comprises: a data line, a gate line, a first power supply line, a second power supply line, a reference signal line, a light emitting device, a driving transistor, a storage capacitor, a reset unit, a data writing unit, a compensating unit and a light emitting control unit;

the data line is configured to supply a data voltage, the gate line is configured to supply a scan voltage, the first power supply line is configured to supply a first power supply voltage, the second power supply line is configured to supply a second power supply voltage, and the reference signal line is configured to supply a reference voltage, the reset unit comprises are reset control line, a reset signal line, a first transistor and a second transistor, is connected to the reference signal line and the storage capacitor, and is configured to reset a voltage across the storage capacitor to a predefined signal voltage, the data writing unit comprises a fourth transistor, is connected to the gate line, the data line and a second terminal of the storage capacitor, and is configured to write information including a data voltage into the second terminal of the storage capacitor, the compensating unit comprises a third transistor, is connected the gate line, a first terminal of the storage capacitor and the driving transistor, and is configured to write information including a threshold voltage of the driving transistor and the first power supply voltage into the first terminal of the storage capacitor, the light emitting control unit comprises a light emitting control line, a fifth transistor and a sixth transistor, is connected to the reference signal line, the second terminal of the storage capacitor, the driving transistor and the light emitting device, and is configured to write the reference voltage into the second terminal of the storage capacitor during a light emitting period and control the driving transistor to drive the light emitting device to emit light, the first terminal of the storage capacitor is connected to a gate of the driving transistor, and the storage capacitor is configured to transfer the information including the data voltage into the gate of the driving transistor, and the driving transistor is connected to the first power supply line, the light emitting device is connected to the second power supply line, and the driving transistor is configured to control an amplitude of a current flowing through the light emitting device according to the information including the data voltage, the threshold voltage of the driving transistor, the reference voltage and the first power supply voltage under the control of the light emitting control unit.

13. The array substrate of claim 12, wherein the first transistor has a gate connected to the reset control line, a source connected the reset signal line and a drain connected to the first terminal of the storage capacitor, and is configured to write a voltage on the reset signal line into the first terminal of the storage capacitor;

the second transistor has a gate connected to the reset control line, a source connected the reference signal line and a drain connected to the second terminal of the storage capacitor, and is configured to write the reference voltage into the second terminal of the storage capacitor.

14. The array substrate of claim 13, wherein the first and second transistors are P type transistors.

15. The array substrate of claim 12, wherein the fourth transistor has a gate connected to the gate line, a source connected the data line and a drain connected to the second terminal of the storage capacitor, and is configured to write the data voltage into the second terminal of the storage capacitor.

16. The array substrate of claim 15, wherein the fourth transistor is a P type transistor.

17. The array substrate of claim 12, wherein the third transistor has a gate connected to the gate line, a source connected to the first terminal of the storage capacitor and a drain connected to the drain of the driving transistor, and is configured to write the information including the threshold voltage of the driving transistor and the first power supply voltage into the first terminal of the storage capacitor.

18. The array substrate of claim 17, wherein the third transistor is a P type transistor.

19. The array substrate of claim 12, wherein the fifth transistor has a gate connected to the light emitting control line, a source connected to the reference signal line and a drain connected to the second terminal of the storage capacitor, and is configured to write the reference voltage into the second terminal of the storage capacitor such that the storage capacitor transfers the reference voltage to the gate of the driving transistor; and the sixth transistor has a gate connected to the light emitting control line, a source connected to a first terminal of the light emitting device and a drain connected to the drain of the driving transistor, and is configured to control the light emitting device to emit light, the driving transistor is configured to control the amplitude of the current flowing through the light emitting device according to the information including the data voltage, the threshold voltage of the driving transistor, the first power supply voltage and the reference voltage under the control of the light emitting control unit.

20. The array substrate of claim 19, wherein the driving transistor, the fifth and sixth transistors are P type transistors.

* * * * *